US011415946B2

(12) United States Patent
Nagy et al.

(10) Patent No.: US 11,415,946 B2
(45) Date of Patent: Aug. 16, 2022

(54) TIMEPIECE COMPRISING A MECHANICAL MOVEMENT WHOSE RATE IS REGULATED BY AN ELECTRONIC DEVICE

(71) Applicant: The Swatch Group Research and Development Ltd, Marin (CH)

(72) Inventors: Laurent Nagy, Liebefeld (CH); Alexandre Haemmerli, Neuchatel (CH); Lionel Tombez, Bevaix (CH)

(73) Assignee: The Swatch Group Research and Development Ltd, Marin (CH)

( * ) Notice: Subject to any disclaimer, the term of this patent is extended or adjusted under 35 U.S.C. 154(b) by 824 days.

(21) Appl. No.: 16/354,217

(22) Filed: Mar. 15, 2019

(65) Prior Publication Data

US 2019/0286063 A1 Sep. 19, 2019

(30) Foreign Application Priority Data

Mar. 16, 2018 (EP) ..... 18162191

(51) Int. Cl.
*G04C 3/04* (2006.01)
*G04B 17/06* (2006.01)
*G04B 17/28* (2006.01)

(52) U.S. Cl.
CPC ..... *G04C 3/047* (2013.01); *G04B 17/063* (2013.01); *G04B 17/066* (2013.01); *G04B 17/28* (2013.01); *G04C 3/04* (2013.01)

(58) Field of Classification Search
CPC .... G04B 17/066; G04B 17/063; G04B 17/28; G04C 3/04; G04C 3/047
See application file for complete search history.

(56) References Cited

U.S. PATENT DOCUMENTS 8,721,169 B2 * 5/2014 Schafroth ..... G04B 17/066 368/171
2013/0051191 A1 * 2/2013 Schafroth ..... G04C 3/047 368/175
2013/0107677 A1 * 5/2013 Willemin ..... G04C 3/067 368/200

FOREIGN PATENT DOCUMENTS

CH 709 279 A2 8/2015
CH 710 603 A2 7/2016
(Continued)

OTHER PUBLICATIONS

European Search report dated Sep. 27, 2018 in European Application 18162191.3, filed on Mar. 16, 2018 (with English translation of Categories of Cited Documents).
(Continued)

*Primary Examiner* — Sean Kayes
(74) *Attorney, Agent, or Firm* — Oblon, McClelland, Maier & Neustadt, L.L.P.

(57) ABSTRACT

A timepiece includes a mechanical oscillator, formed by a balance and a piezoelectric balance spring, and a regulating device for regulating the frequency of the mechanical oscillator which is arranged to be able to produce time-separated regulating pulses, each consisting of a momentary decrease in an electrical resistance applied by the regulating device between two electrodes of the balance spring relative to a nominal electrical resistance. Each regulating pulse produces a variation of rate which varies as a function of its moment of starting in a half-period of the mechanical oscillator, the characteristic function of this variation of rate relative to the moment of starting of at least one regulating pulse respectively in at least one half-period of the mechanical oscillator being negative in a first temporal zone of at least one half-period and positive in a second temporal zone of at least one half-period.

8 Claims, 7 Drawing Sheets

(56) References Cited

FOREIGN PATENT DOCUMENTS

| | | | |
|---|---|---|---|
| CN | 101008825 | A | 8/2007 |
| CN | 103003760 | A | 3/2013 |
| CN | 107463082 | A | 12/2017 |
| EP | 1 164 441 | A1 | 12/2001 |
| EP | 1 605 323 | A2 | 12/2005 |
| EP | 2 590 035 | A1 | 5/2013 |

OTHER PUBLICATIONS

Combined Chinese Office Action and Search Report dated Jul. 20, 2020 in Patent Application No. 201910193381.2 (with English translation of Categories of Cited Documents), 6 pages.

* cited by examiner

TIMEPIECE COMPRISING A MECHANICAL MOVEMENT WHOSE RATE IS REGULATED BY AN ELECTRONIC DEVICE

CROSS-REFERENCE TO RELATED APPLICATION

This application claims priority to European Patent Application No. 18162191.3 filed on Mar. 16, 2018, the entire disclosure of which is hereby incorporated herein by reference.

FIELD OF THE INVENTION

The present invention concerns a timepiece including a mechanical movement, provided with a mechanical oscillator which is formed by a balance and a balance spring, and an electronic regulating device for regulating the frequency of the mechanical oscillator which controls the rate of the mechanical movement.

In particular, the electronic regulating device includes an auxiliary electronic oscillator, which is generally more precise than the mechanical oscillator, in particular a quartz oscillator, and a measuring device arranged to be able to measure, where necessary, a time deviation of the mechanical oscillator with respect to the auxiliary oscillator.

BACKGROUND OF THE INVENTION

Several documents concern the electronic regulation of a mechanical oscillator in a timepiece. In particular, US Patent Application No 2013/0051191 concerns a timepiece including a balance/balance spring and an electronic circuit for regulating the oscillation frequency of this balance/balance spring. The balance spring is formed of a piezoelectric material or includes two lateral layers of piezoelectric material on a silicon core, two external lateral electrodes being arranged on the lateral surfaces of the balance spring. These two electrodes are connected to the electronic regulating circuit which includes a plurality of switchable capacitances arranged in parallel and connected to the two electrodes of the balance spring.

With reference to FIGS. 1 to 4, a timepiece of the type disclosed in the aforementioned US Patent Application will be described. To avoid overloading the drawing, FIG. 1 represents only mechanical resonator 2 of the mechanical movement of the timepiece, this resonator comprising a balance 4 oscillating about a geometric axis 6 and a balance spring 8 whose terminal curve 10 passes in a conventional manner through a stud 12 integral with a balance-cock (not represented) of the mechanical movement. FIG. 2 schematically represents a portion of balance spring 8. This balance spring is formed by a central silicon body 14, two lateral layers 16, 18 of piezoelectric material, particularly aluminium nitride (AlN), and two external metal electrodes 20, 22. The two electrodes are connected by conductive wires 26, 28 (schematic representation) to an electronic regulating circuit 24.

FIG. 3 (which reproduces FIG. 1 of the prior art document concerned with some additional information from FIGS. 2 and 7) shows the general arrangement of regulating device 32 which is incorporated in the timepiece in question and in particular the electronic regulating circuit 24. This circuit 24 includes a first capacitor 34 connected to two electrodes of the piezoelectric balance spring and a plurality of switchable capacitors 36*a* to 36*d* which are arranged in parallel with the first capacitor, so as to form a variable capacitance $C_V$ in order to vary the value of the capacitance connected to the electrodes of the balance spring and thus to vary, according to the teaching of the document, the stiffness of the balance spring. Circuit 24 further includes a comparator 38 whose two inputs are respectively connected to the two electrodes of balance spring 8, this comparator being arranged to provide a logic signal for determining, by means of the successive logic state changes of this logic signal, the zero-crossings of the induced voltage between the two electrodes of the balance spring. The logic signal is provided to a logic circuit 40 which also receives a reference signal from a clock circuit 42 associated with a quartz resonator 44. Based on a comparison between the reference signal and the logic signal provided by comparator 38, logic circuit 40 controls the switches of switchable capacitors 36*a* to 36*d*.

Further, after the switchable capacitor circuit there is arranged a full-wave rectifier circuit 46 conventionally formed of a four-diode bridge, which provides a continuous voltage VDC and loads a storage capacitor 48. This electrical energy provided by the piezoelectric balance spring powers device 32. This is thus an autonomous electrical system, since it is self-powered in the sense that the electrical energy comes from the mechanical energy provided to mechanical resonator 2, whose piezoelectric balance spring 8, forms an electromechanical transducer (an electrical current generator) when the mechanical resonator oscillates.

As indicated in US Patent No 2015/0051191 at paragraph 0052, electronic regulating circuit 24 can only reduce the oscillation frequency of mechanical resonator 2 by increasing the value of variable capacitance $C_V$. This observation is confirmed by the graph of FIG. 4 which shows the curve 50 giving the variation of rate according to the value of variable capacitance $C_V$. Indeed, it is observed that the variation of rate obtained is always less than zero and increases in absolute value when the value of the variable capacitance increases. Thus, the regulating system requires the natural frequency of the mechanical oscillator (frequency in the absence of regulation) to be higher than the nominal frequency (desired frequency) of this mechanical oscillator. In other words, it is intended to adjust the mechanical oscillator so that its natural frequency corresponds to a frequency higher than the desired frequency, the function of the regulating circuit being to decrease this natural frequency more or less so that the rate corresponds to the desired frequency. Thus, a great disadvantage of such a system lies in the fact that the rate of the mechanical movement is not optimal in the absence of electronic regulation. For a high precision timepiece movement, it is actually necessary to degrade its natural mechanical features with a non-optimal setting. It can be concluded that such an electronic regulating system only makes sense for mechanical movements of average quality or even poor quality, since the precision of these mechanical movements depends on the electronic regulating system.

SUMMARY OF THE INVENTION

It is an object of the present invention to propose a timepiece, provided with a mechanical resonator, comprising a balance spring at least partially formed of a piezoelectric material, and an electronic regulating system associated with the piezoelectric balance spring, which does not have the drawbacks of the aforementioned prior art timepiece, in particular, which can be associated with a mechanical movement whose rate is initially set in an optimal manner, i.e. to the best of its abilities. Thus, it is an object of the invention to provide an electronic regulating system, which is discrete and autonomous owing to the use of a piezoelectric balance spring, and which is genuinely complementary to the mechanical movement since it increases precision without thereby degrading an optimal initial setting of the mechanical movement.

The invention concerns a timepiece comprising a mechanical timepiece movement, provided with a mechanical oscillator formed by a balance and a balance spring and arranged to set the rate of the timepiece movement, and a regulating device to regulate the frequency of the mechanical oscillator, this regulating device including an auxiliary time base, formed by an auxiliary oscillator and providing a reference frequency signal, and a device for measuring a time deviation in the rate of the timepiece movement with respect to a desired mechanical oscillator frequency which is determined by the auxiliary time base. The balance spring is at least partially formed of a piezoelectric material and by at least two electrodes arranged to be able to have between them an induced voltage produced by the piezoelectric material when the latter is under mechanical stress during an oscillation of the mechanical oscillator, the two electrodes being electrically connected to the regulating device which is arranged to be able to vary the impedance of the regulating system, formed by the piezoelectric material, said at least two electrodes and the regulating device, as a function of a time deviation measuring signal provided by the measuring device. More particularly, according to the invention, the regulating device is arranged to be able to momentarily vary the electrical resistance produced by this regulating device between the two balance spring electrodes and to be able to produce time-separated regulating pulses, each consisting of a momentary decrease in electrical resistance relative to a nominal electrical resistance, which is produced by the regulating device between said two electrodes outside the regulating pulses. According to a remarkable physical characteristic brought to light by the inventors, each of the aforementioned regulating pulses produces a variation of rate in the mechanical movement which varies as a function of its moment of starting in a half-period of the mechanical oscillator, the characteristic function of this variation of rate relative to the moment of starting of at least one regulating pulse respectively in at least one half-period of the mechanical oscillator being negative in a first temporal part of this at least one half-period and positive in a second temporal part of this at least one half-period. The regulating device is arranged to be able to determine whether a time deviation measured by the measuring device corresponds to at least some gain or at least some loss and to generate at least one regulating pulse with a selectively arranged pulse start, depending on whether the measured time deviation corresponds to said at least some gain or to said at least some loss, in said first temporal part or in said second temporal part respectively of at least one half-period of the mechanical oscillator.

As a result of the features of the timepiece according to the invention, it is thus possible to correct both a gain and a loss in the rate of a mechanical movement by means of regulating pulses, each having a limited duration, which vary the resistance between the two electrodes of the balance spring in different temporal parts of corresponding half-periods depending on whether a gain or a loss was detected in the rate of the mechanical movement.

In a preferred embodiment, the regulating device includes a switch arranged between the two electrodes of the balance spring, this switch being controlled by a control circuit which is arranged to momentarily close this switch to make it conductive during the regulating pulses, which then generate short circuit pulses.

BRIEF DESCRIPTION OF THE DRAWINGS

The invention will be described in more detail below with reference to the annexed drawings, given by way of non-limiting example, and in which.

DETAILED DESCRIPTION OF THE INVENTION

Figure 2:
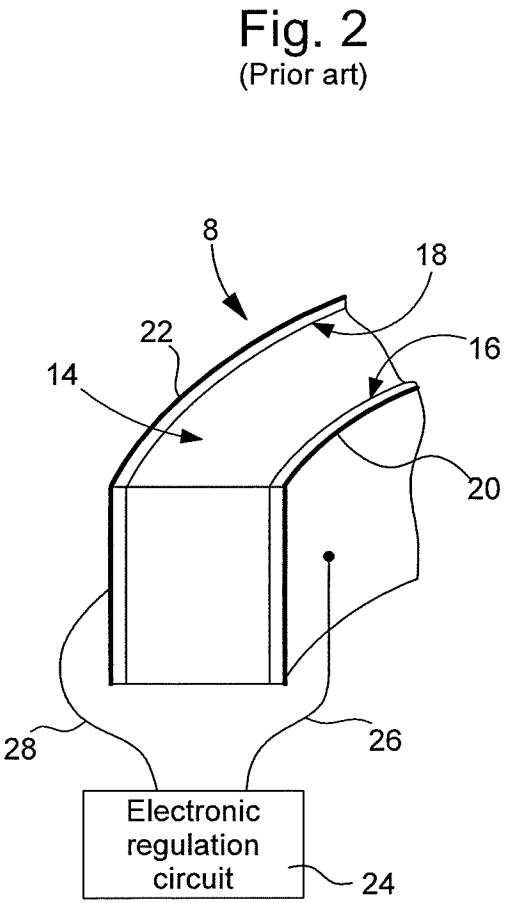
Fig. 2 (Prior art)
FIG. 2 is an enlargement of a portion of the piezoelectric balance spring of FIG. 1.
Figure 1:
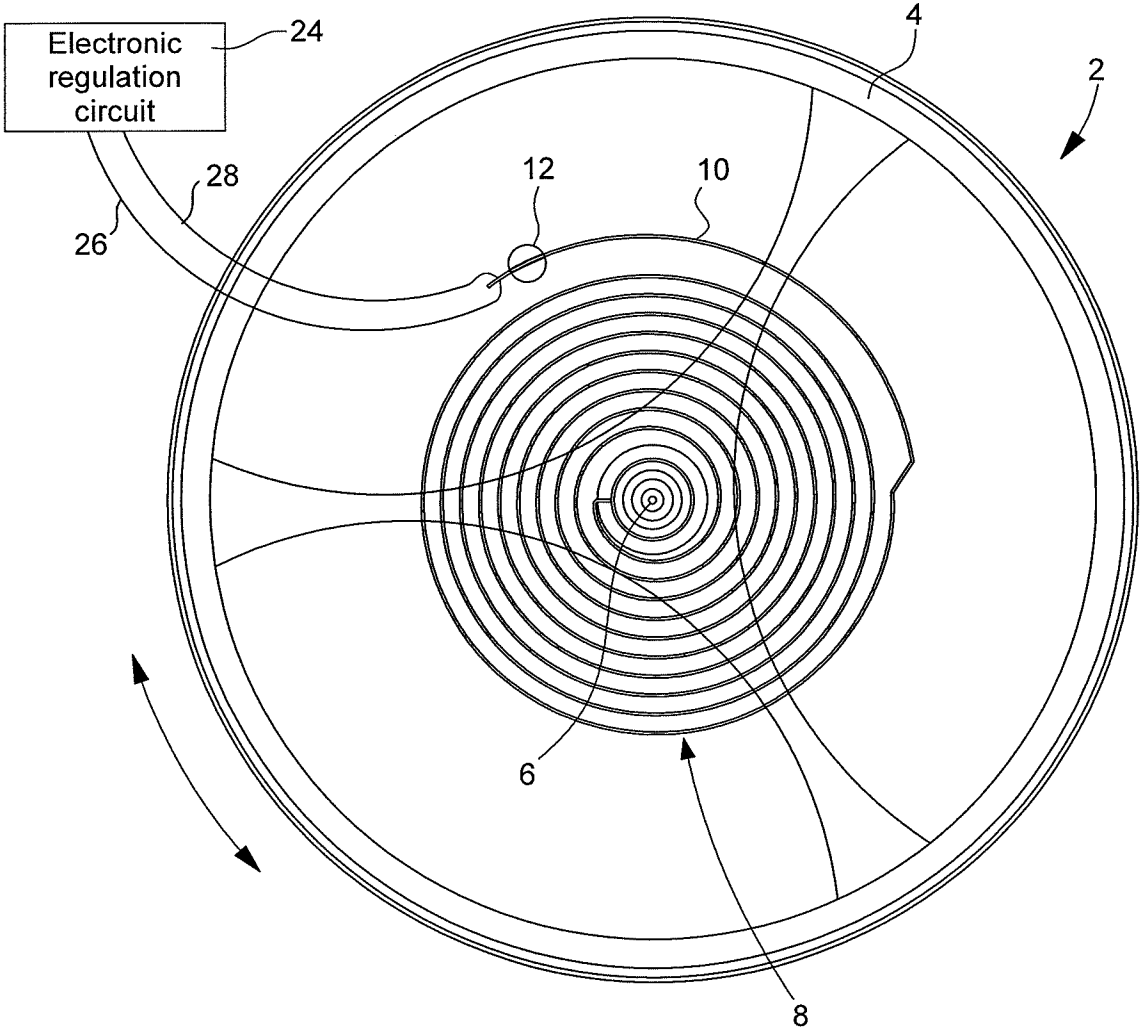
Fig. 1 (Prior art)
FIG. 1, already described, shows a prior art timepiece including a mechanical timepiece resonator, having a piezoelectric balance spring, and an electronic regulating circuit which is connected to both electrodes of the piezoelectric balance spring.
Figure 3:
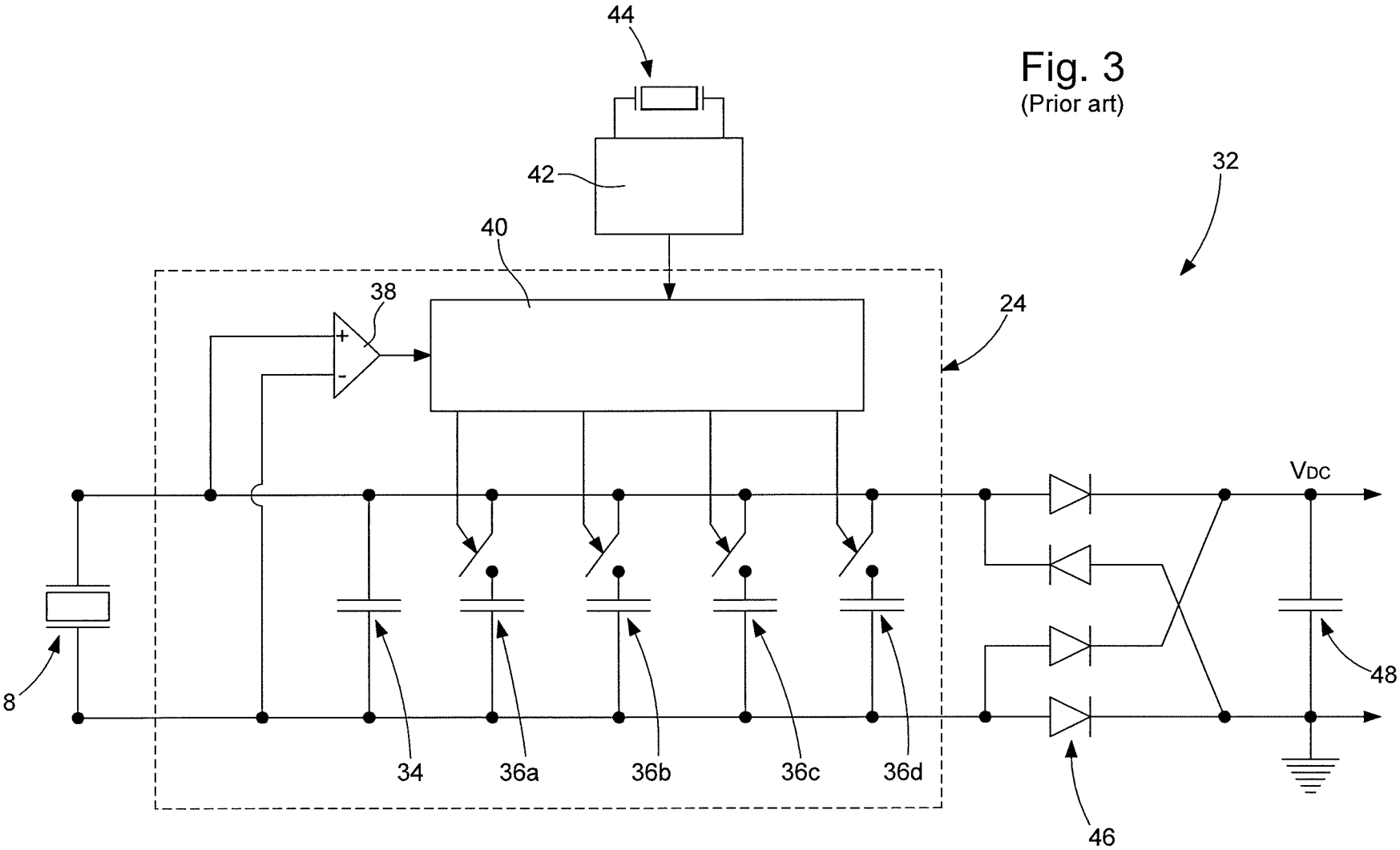
Fig. 3 (Prior art)
FIG. 3 partially shows the electrical diagram of the regulating device of the timepiece of FIG. 1.
Figure 4:
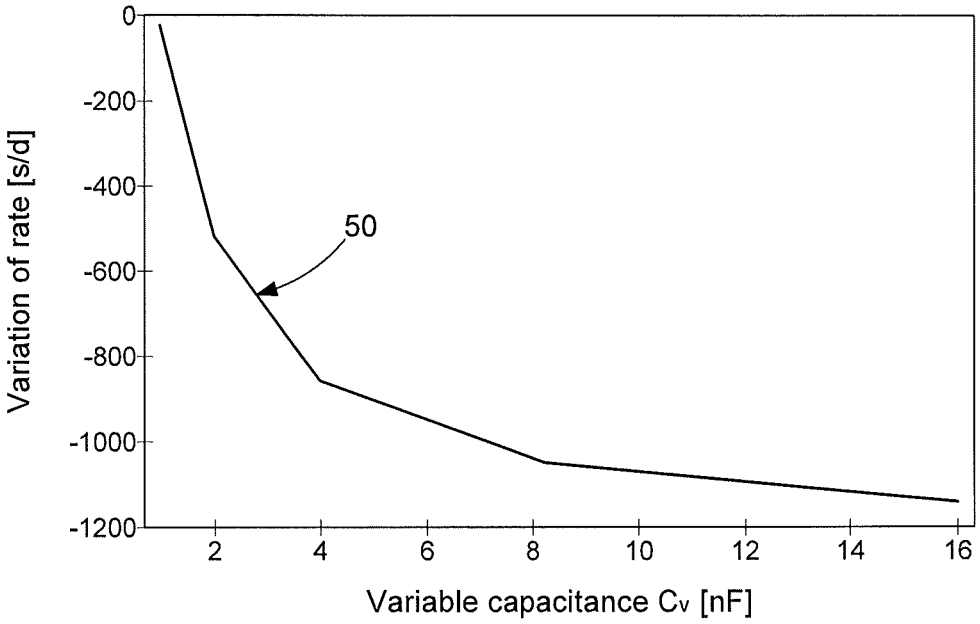
Fig. 4 (Prior art)
FIG. 4 shows the variation of rate for the timepiece of the preceding Figures as a function of a variable capacitance applied between the two electrodes of the piezoelectric balance spring.
Figure 5:
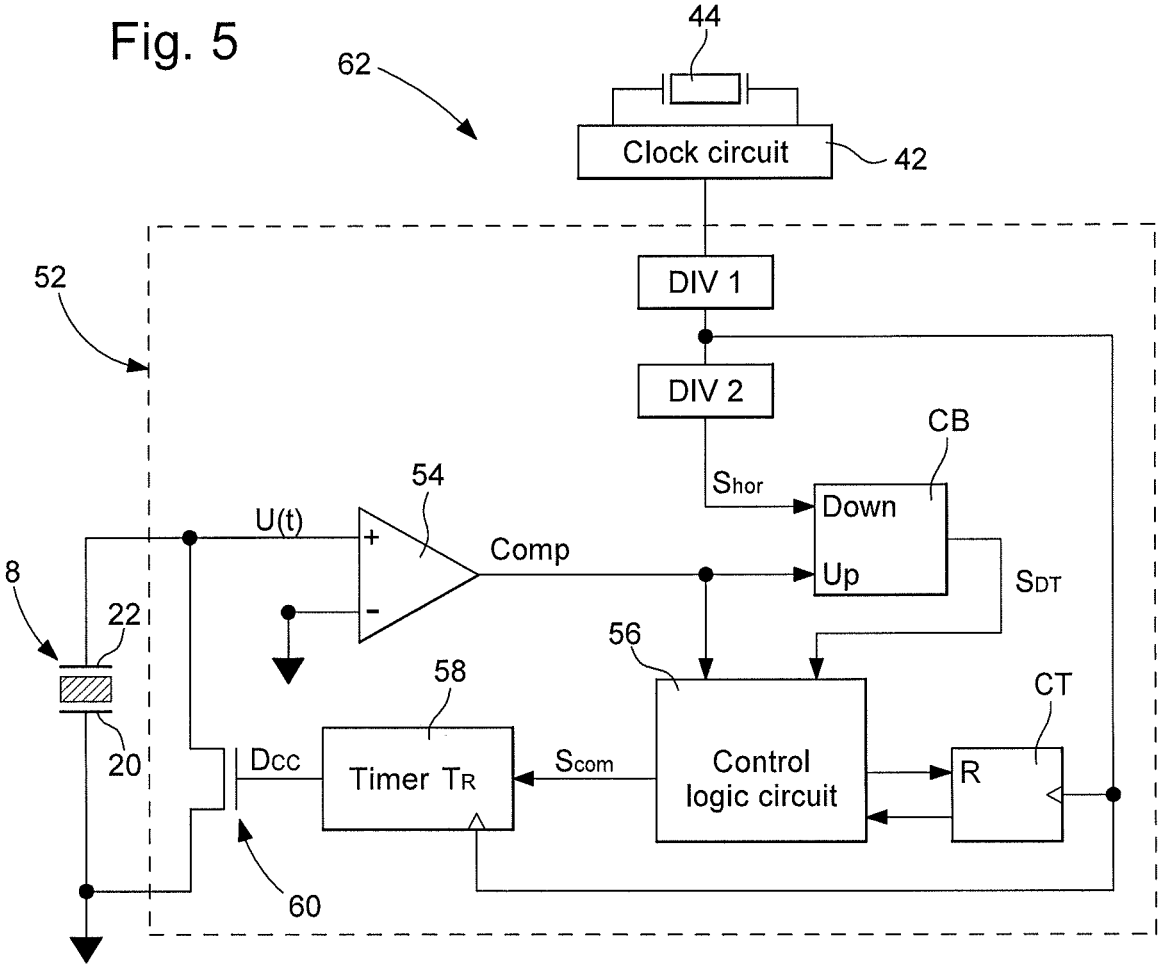
FIG. 5 shows the electrical diagram of a regulating device incorporated in an embodiment of a timepiece according to the invention which includes a mechanical resonator with a piezoelectric balance spring.

The timepiece according to the invention comprises, like the prior art timepiece described above, a mechanical timepiece movement provided with a mechanical oscillator formed by a balance and a piezoelectric balance spring and arranged to set the rate of the timepiece movement. Next, the timepiece includes a regulating device 62 whose electric diagram is represented in FIG. 5. This regulating device, which is arranged to regulate the frequency of the mechanical oscillator, includes an electronic regulation circuit 52 and an auxiliary time base which is formed by an auxiliary oscillator and which provides a reference frequency signal to the electronic regulation circuit. This time base includes, for example, a quartz resonator 44 and a clock circuit 42 which supplies the reference frequency signal to a divider having at least two stages DIV1 and DIV2. Piezoelectric balance spring 8 is at least partially formed by a piezoelectric material and by at least two electrodes 20, 22 (see FIGS. 2, 5 and 11) which are arranged to be able to have between them an induced voltage U(t) produced by said piezoelectric material when the latter is subjected to mechanical stress during oscillation of the mechanical oscillator (see FIG. 7). The two electrodes are electrically connected to electronic regulation circuit 52.

The electronic regulation circuit includes a device for measuring for any time deviation in the rate of the timepiece movement relative to a desired frequency for the mechanical oscillator which is determined by the auxiliary time base 42, 44. In the embodiment represented in FIG. 5, the measuring device is formed by a hysteresis comparator 54 whose two inputs are connected to the two electrodes 20, 22 of piezoelectric balance spring 8. It will be noted that in the example shown, electrode 20 is electrically connected to an input of comparator 54 via the mass of the regulating device. The hysteresis comparator supplies a digital signal 'Comp' (see FIGS. 5 and 7) whose logic state changes just after each passage of the mechanical oscillator through its neutral position (angular position θ(t) equal to zero), more particularly after each zero crossing of the mechanical resonator forming this mechanical oscillator. The induced voltage U(t) produced by the piezoelectric balance spring is zero during passage of the mechanical resonator through its neutral position (angular position 'zero'), whereas it is maximum, for a given load applied between the two electrodes, when the mechanical resonator is in one or other of its two extreme positions (defining the amplitude of the mechanical oscillator respectively on either side of the neutral position).

Signal 'Comp' is provided, on the one hand, to a first input 'Up' of a two-directional counter CB forming the measuring device and, on the other hand, to a control logic circuit 56. The two-directional counter is thus incremented by one unit at each oscillation period of the mechanical oscillator. It thus continuously receives a measurement of the instantaneous oscillation frequency of the mechanical oscillator. The two-directional counter receives at its second input 'Down' a clock signal $S_{hor}$ provided by frequency divider DIV1 and DIV2, this clock signal defining a desired frequency for the mechanical oscillator which is determined by the auxiliary oscillator of the auxiliary time base. Thus, the two-directional counter supplies the control logic circuit 56 with a signal corresponding to a cumulative error over time between the oscillation frequency of the mechanical oscillator and the desired frequency, this cumulative error defining the time deviation of the mechanical oscillator relative to the auxiliary oscillator.

Generally, the regulating device according to the invention is arranged to be able to momentarily vary the electrical resistance produced by this regulating device between the two electrodes of the piezoelectric balance spring as a function of a time deviation measurement signal of the timepiece rate which is provided by a device for measuring this time deviation. More particularly, the regulating device is arranged to be able to produce time-separated regulating pulses, each consisting of a momentary decrease in the aforementioned electrical resistance relative to a nominal electrical resistance which is produced by the regulating device between the two electrodes outside the regulating pulses. There is therefore provided a system for regulating the timepiece rate and thus the mean frequency of the mechanical oscillator, which is formed by the piezoelectric material of balance spring 8, the two electrodes 20, 22 of this balance spring and the regulating device according to the invention.

In a preferred embodiment, regulating device 62 includes a switch 60 arranged between the two balance spring electrodes, this switch being controlled by control logic circuit 56, which is arranged to momentarily close the switch to make it conductive during said regulating pulses, which then generate short circuit pulses.

Figure 6:
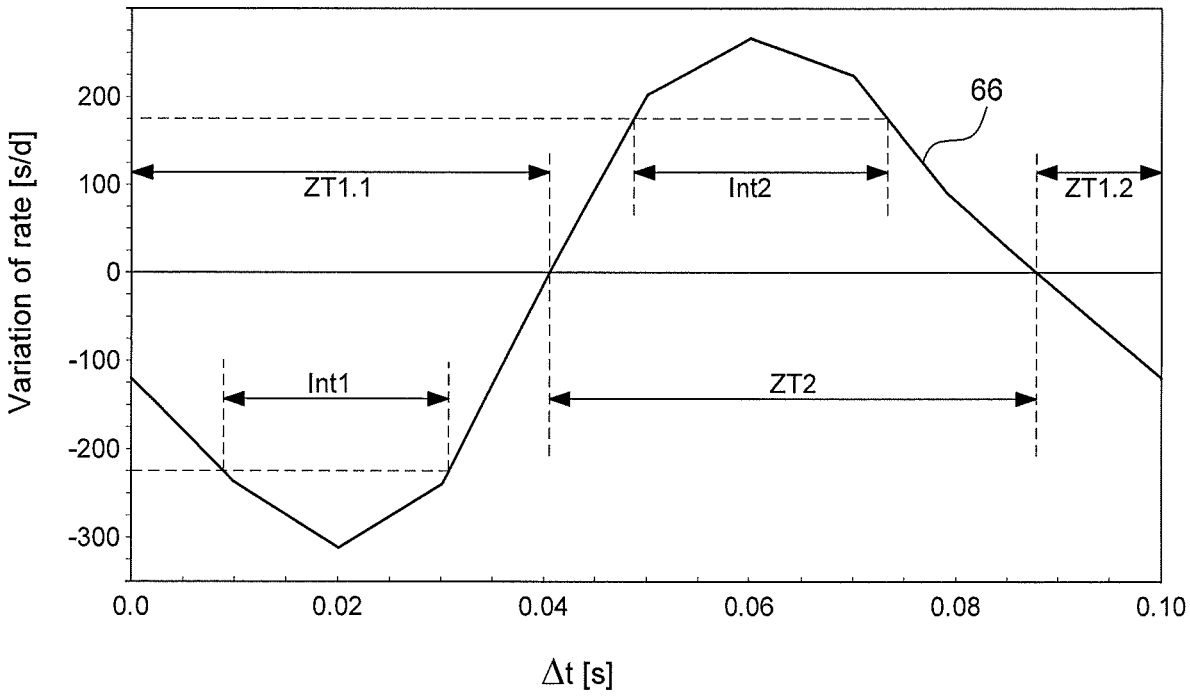
FIG. 6 shows the variation of rate per day, for the timepiece according to the invention, which is produced by the regulating device of FIG. 5 as a function of the start of short circuit pulses, during respective oscillation periods, in a half-period between two passages of the mechanical resonator through the neutral position of in each of these oscillation periods.

Within the context of the invention, the inventors discovered that the aforementioned regulating pulses each produce a variation of rate of the mechanical movement that is variable as a function of the moment of starting of the regulating pulse concerned in a half-period of the mechanical oscillator. This observation is represented in FIG. 6, which gives the characteristic function 66 of the variation of rate of the timepiece in one day relative to the moment of starting of the short circuit pulses respectively in all the oscillation periods of the mechanical oscillator throughout one day, more particularly in respective half-periods of these oscillation periods which are defined, in each oscillation period, by the two successive passages of the mechanical oscillator through the neutral position. Thus, the abscissa of the graph of FIG. 6 corresponds to the time interval Δt between the start of short circuit pulses in the respective oscillation periods and the start of the half-period concerned in these oscillation periods. Remarkably, the inventors brought to light the fact that the variation of rate is negative in a first temporal part ZT1=ZT1.1 & ZT1.2 of the half-period considered for the start of short circuit pulses and that it is positive over a second temporal part ZT2 of this half-period. It will also be noted that the characteristic function 66 represented in FIG. 6 concerns a variant wherein the oscillation frequency is substantially equal to 5 Hz (oscillation period=200 ms). The variation of rate in seconds per day [s/d] is given as a function of the moment of starting of short circuit pulses in a half-period of 100 ms, between two successive passages of the mechanical resonator through its neutral position, during each of the successive oscillation periods. The short circuit pulses each last 10 ms in the example represented, but this is not limiting.

The electronic regulating circuit is arranged to be able to determine whether a time deviation measured by the measuring device corresponds to at least some gain (CB>N1) or to at least some loss (CB<−N2), the state of two-directional counter CB being provided to control logic circuit 56 by signal SDT which provides the state of the two-directional counter. The regulating device is arranged to produce at least one regulating pulse with a selectively arranged start, depending on whether the measured time deviation corresponds to said at least some gain or to said at least some loss, in the first temporal part ZT1 or in said second temporal part ZT2 respectively of at least one half-period of the mechanical oscillator. Indeed, a short circuit pulse of limited duration starting in the first temporal part produces a loss in the mechanical oscillator (negative phase shift) which can at least partly correct a gain detected in the timepiece rate, whereas a short circuit pulse of limited duration starting in the second temporal part produces a gain in the mechanical oscillator (positive phase shift) which can at least partly correct a loss detected in the timepiece rate.

Figure 7:
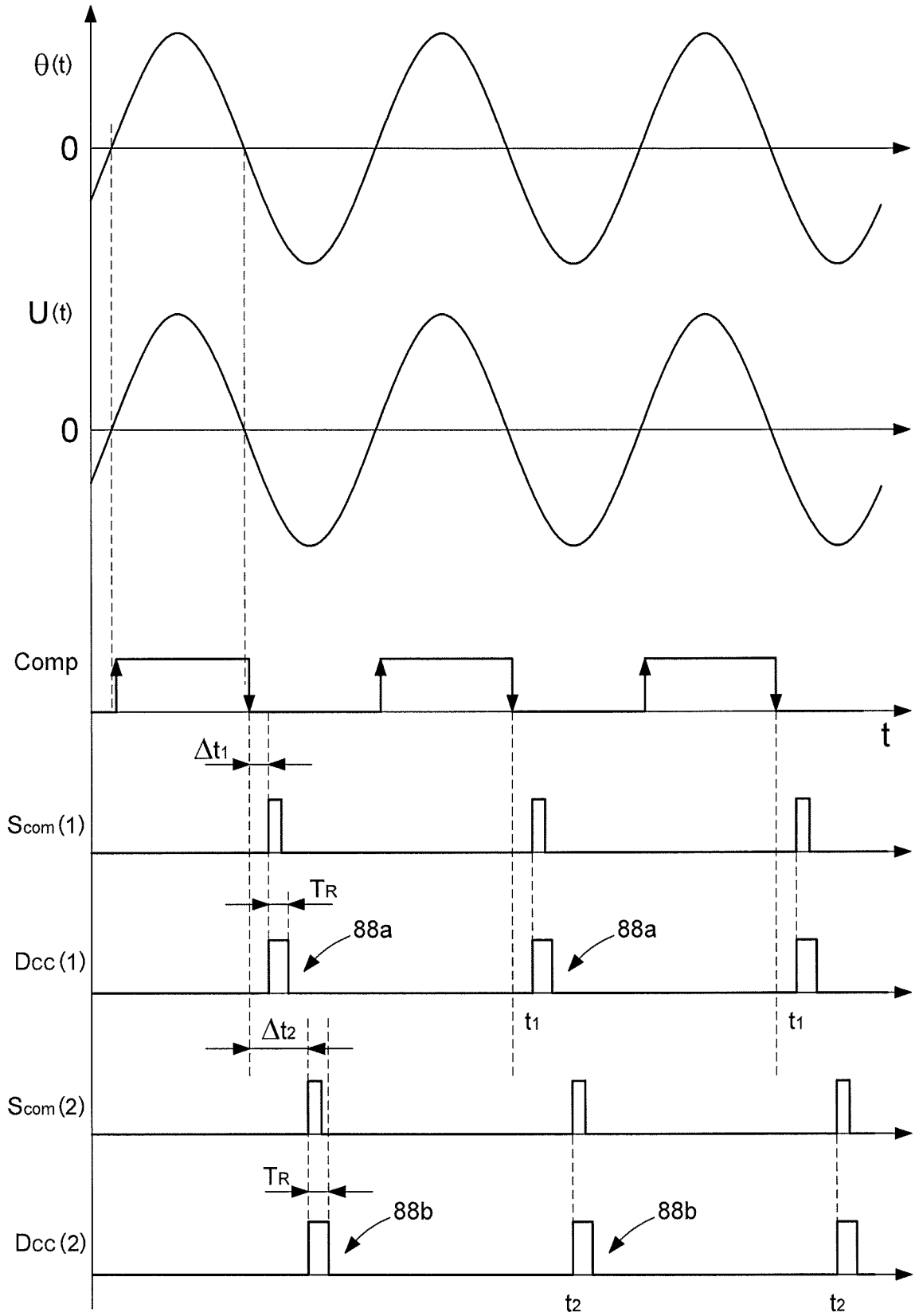
FIG. 7 shows a short circuit pulse generating mode in the regulating device of FIG. 5 as a function of a measured time deviation in the rate of the timepiece.
Figure 9:
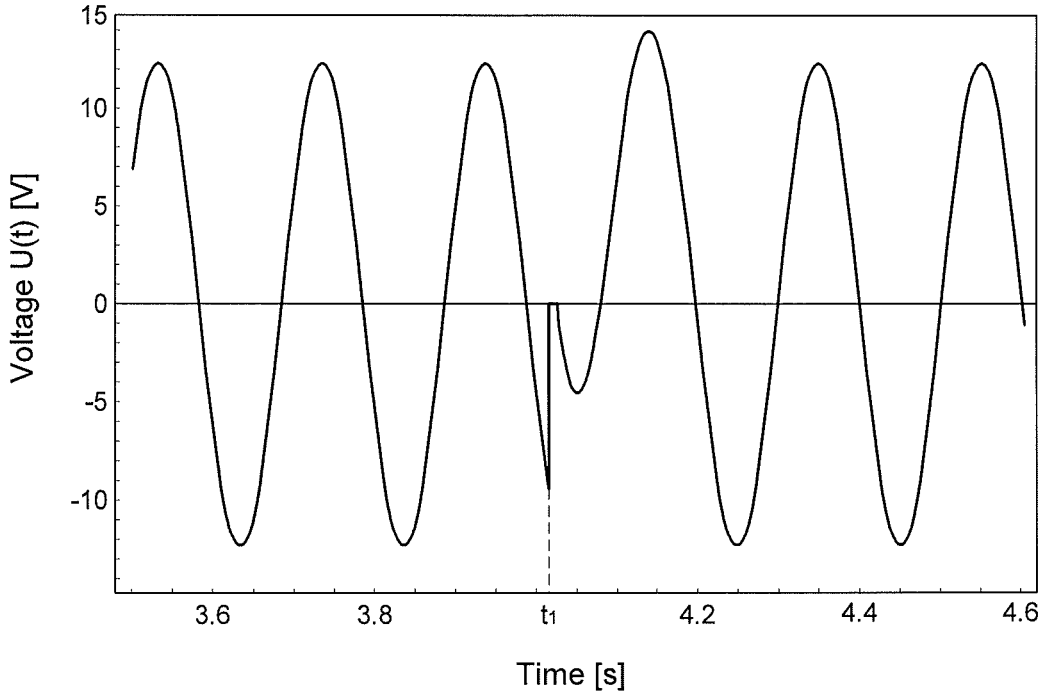
FIGS. 9 and 10 show the graph of the induced voltage between the electrodes of the piezoelectric balance spring when a short circuit pulse is produced respectively before and after a passage of the mechanical resonator through an extreme position (between two successive passages of the mechanical resonator through its neutral position).
Figure 10:
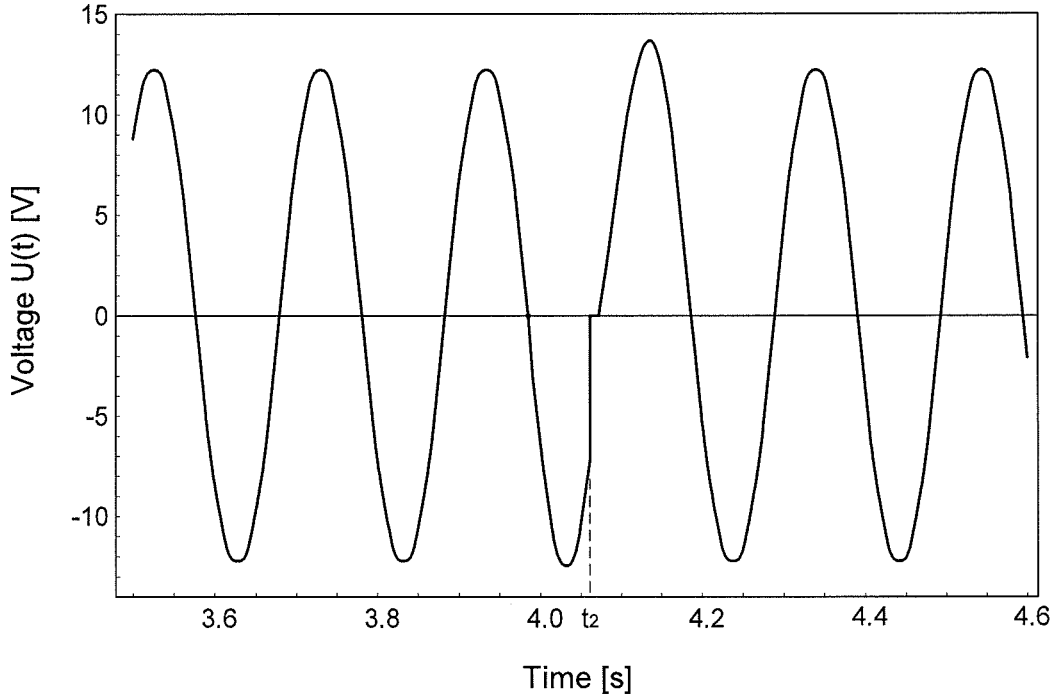

FIGS. 9 and 10 show the graph of the induced voltage U(t) between the electrodes of the piezoelectric balance spring during a short circuit pulse starting respectively at instant t1 in the first temporal part ZT1 of any oscillation period and at instant t2 in the second temporal part ZT2 of any oscillation period, i.e. respectively before and after the mechanical oscillator passes through an extreme position between two successive passages of this mechanical oscillator through its neutral position defining the half-period concerned (see FIG. 7).

In a general variant, the regulating pulses each have a duration less than a quarter of the desired period which is equal to the inverse of said desired frequency of the mechanical oscillator.

In a preferred variant, the duration of the regulating pulses is less than or equal to one tenth of a desired period. At most, one regulating pulse is produced per half-period of the mechanical oscillator and preferably at most one regulating pulse per oscillation period. Next, the regulating device is arranged to produce at least one regulating pulse with a selectively arranged start, depending on whether the measured time deviation corresponds to at least some gain or at least some loss, in a first time interval Int1 within first temporal part ZT1, wherein the variation of rate given by said characteristic function 66 is greater, in absolute value, than at least half of a maximum variation of rate of this characteristic function over the first temporal part, or in a second time interval Int2 within second temporal part ZT2 and wherein the variation of rate given by the characteristic function is greater than at least half of a maximum variation of rate of this characteristic function over the second temporal part. This therefore ensure a relatively large effect during the regulating pulses, in particular during the short circuit pulses.

Figure 8:
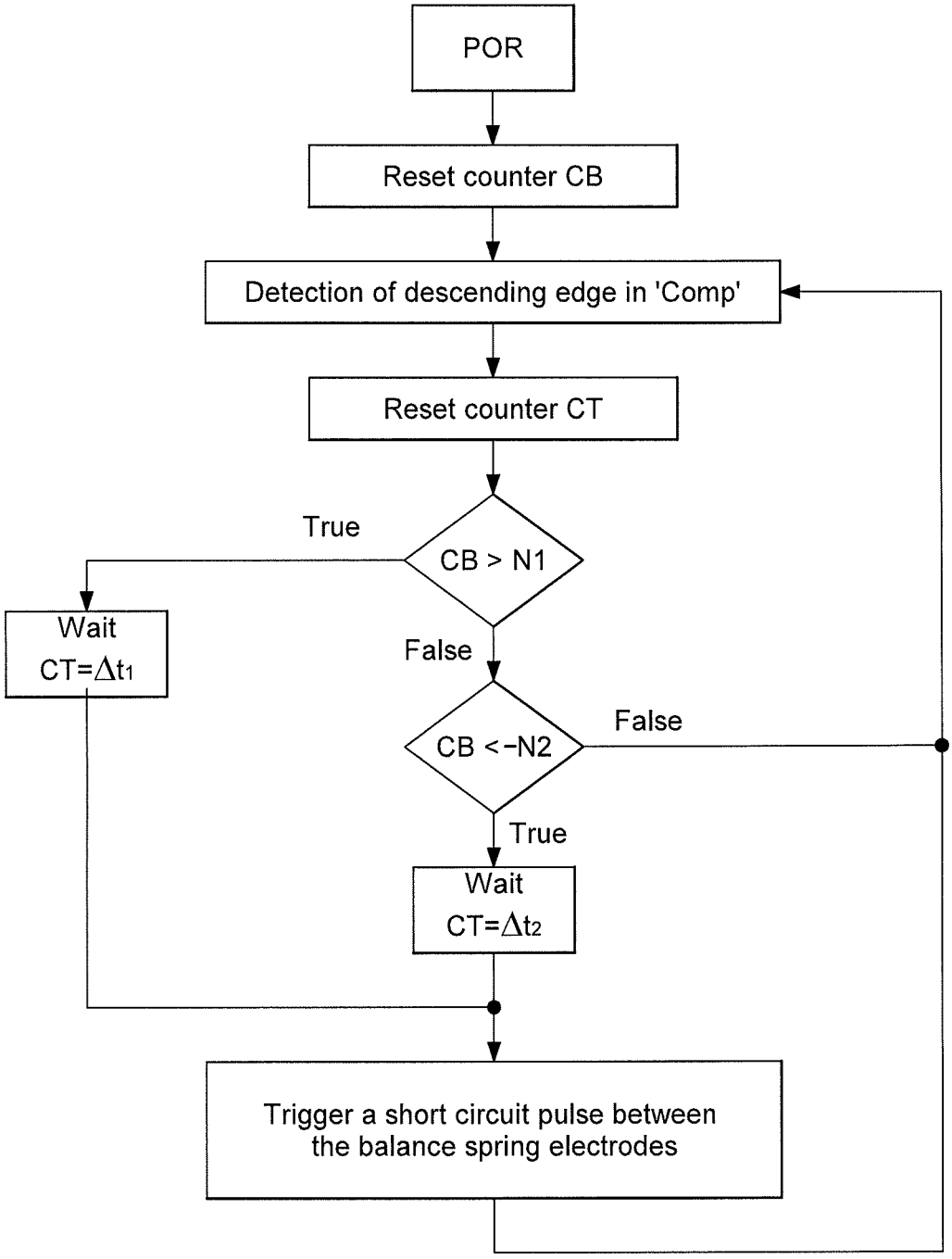
FIG. 8 is a flow chart of a regulating method implemented in the regulating device of FIG. 5.

With reference to FIGS. 7 and 8, a regulating method according to the invention which is implemented by regulating device 62 will be described, this regulation method conforming to the features of the invention described above. As already indicated, hysteresis component 54 provides a signal 'Comp' to control logic circuit 56, which also receives a measurement signal $S_{DT}$ of the time deviation of the mechanical oscillator, and thus of the timepiece concerned. Each rising edge and each descending edge of signal 'Comp' indicate that the mechanical resonator has just crossed its neutral position, respectively during two successive vibrations of the mechanical oscillator. The control circuit selectively provides a control signal $S_{com}$ to a timer 58 which controls a transistor 60 forming the switch by applying a signal $D_{CC}$ thereto. More precisely, the control circuit determines the moment of starting of each short circuit pulse 88*a*, 88*b* by starting or resetting the timer ('Timer') which immediately turns transistor 60 on/conductive (switch closed), the timer determining the duration TR of each short circuit pulse. At the end of each short circuit pulse, the timer opens the switch again so that transistor 60 is off, i.e. non-conductive.

Taking advantage of characteristic function 66 described above, the control logic circuit is associated with a time counter Ct for measuring at least two time intervals $\Delta t_1$ and $\Delta t_2$ in order to selectively start timer 58 in first interval Int1 and second interval Int2 of a half-period, as considered in FIG. 6, depending on whether the control circuit has determined a gain or a loss, namely a positive or negative time deviation, in the rate of the mechanical oscillator. More precisely, when the control circuit detects a descending edge (or alternatively a rising edge) in signal 'Comp', it resets counter CT. If signal $S_{DT}$ indicates a gain, i.e. CB>N1, N1 being a positive natural number, then the control circuit waits for a time interval $\Delta t_1$ to activate the timer with a signal $S_{com}$(1), the timer then produces a signal $D_{CC}$(1) which makes transistor 60 conductive at time $t_1$ (in first temporal part ZT1, preferably in first time interval Int1) for a duration $T_R$, thus causing a first short circuit pulse 88*a* which produces a negative phase shift in the oscillation of the mechanical oscillator (increase in oscillation period and thus decrease in instantaneous frequency). However, if signal SST indicates a loss, i.e. CB<–N2, N2 being a positive natural number, then the control circuit waits for a time interval time $\Delta t_2$ to activate the timer with a signal $S_{com}$(2), the timer then produces a signal $D_{CC}$(2) which makes transistor 60 conductive at time $t_2$ (in second temporal part ZT2, preferably in second interval Int2) also for a duration $T_R$, thus producing a second short circuit pulse 88*b* which generates a positive phase shift in the oscillation of the mechanical oscillator (decrease in oscillation period/increase in instantaneous frequency).

it will be noted that the algorithm given by the flow chart of FIG. 8 can have different variants. Thus, in particular, it is possible to provide a sub-sequence, when some gain or some loss has been noted, in which a plurality of short circuit pulses is produced in a respective plurality of oscillation periods. In such case, a variant can be provided wherein the plurality of short circuit pulses is produced in successive oscillation periods or another variant wherein these short circuit pulses are periodically produced every N oscillation periods, N being an integer number greater than one (N>1). In theoretically less advantageous variant, it is, however, possible to produce a plurality of regulating pulses in a plurality of consecutive half-periods. In this latter case, a regulating pulse will be alternately triggered when a descending edge and a rising edge appear in signal 'Comp'.

Figure 11:
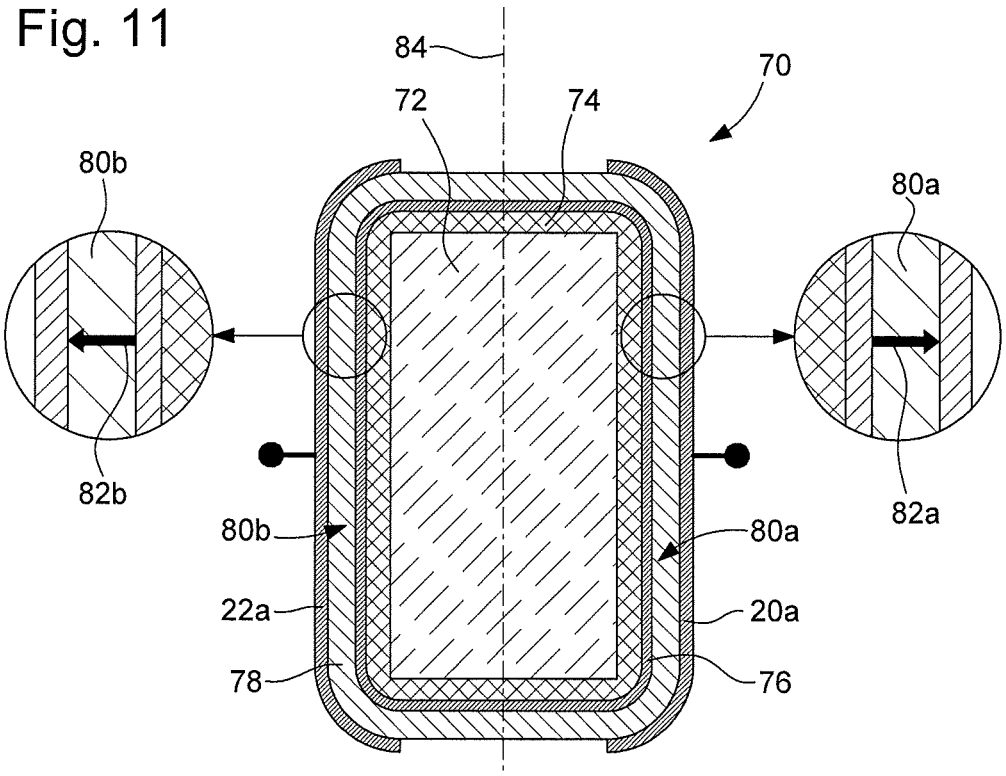
FIG. 11 is a cross-section of a preferred embodiment of a piezoelectric balance spring forming the mechanical resonator of a timepiece according to the invention.

Referring to FIG. 11 (page 4/7 of the annexed drawings), a preferred embodiment of piezoelectric balance spring 70 of the timepiece according to the invention will be described. This balance spring 70, represented in cross-section, includes a central silicon body 72, a silicon oxide layer 74 deposited at the surface of the central body for temperature compensation of the balance spring, a conductive layer 76 deposited on the silicon oxide layer, and a piezoelectric material deposited in the form of a piezoelectric layer 78 on conductive layer 76. Two electrodes 20*a* and 22*a* are arranged on piezoelectric layer 78 respectively on the two lateral sides of the balance spring (the two electrodes can partly cover the upper and lower sides of the balance spring but without joining).

In the particular variant represented in FIG. 11, the first part 80*a* and second part 80*b* of the piezoelectric layer respectively extending over the two lateral sides of central body 72 have, through their growth from conductive layer 76, respective crystallographic structures which are symmetrical with respect to a median plane 84 parallel to these two lateral sides. Thus, in the two lateral parts 80*a* and 80*b*, the piezoelectric layer has two same respective piezoelectric axes 82*a*, 82*b* which are perpendicular to the piezoelectric layer and of opposite directions. There is therefore an inversion of the sign of the induced voltage between the internal electrode and each of the two external lateral electrodes for the same mechanical stress. Thus, when the balance spring contracts or expands from its rest position, there is a reversal of mechanical stress between first and second parts 80*a* and 80*b*, i.e. one of these parts is subjected to compression while the other is subjected to traction, and vice versa. Finally, as a result of these considerations, the induced voltages in the first and second parts have the same polarity on an axis perpendicular to the two lateral sides, such that conductive layer 76 can form a single same internal electrode which extends from the two lateral sides of central body 72, this internal electrode having no electrical connection of its own to the regulating device. In a particular variant, the piezoelectric layer consists of an aluminium nitride crystal formed by crystal growth from conductive layer 76 (internal electrode) and perpendicular thereto.

The invention claimed is:

1. A timepiece comprising a mechanical timepiece movement, provided with a mechanical oscillator formed by a balance and a balance spring and arranged to set the rate of the timepiece movement, and a regulating device for regulating the frequency of the mechanical oscillator, said regulating device including an auxiliary time base, formed by an auxiliary oscillator and providing a reference frequency signal, and a device for measuring a time deviation in the rate of the timepiece movement with respect to a desired frequency of the mechanical oscillator which is determined by the auxiliary time base, the balance spring being at least partially formed by a piezoelectric material and by at least two electrodes arranged to be able to have therebetween a voltage induced by said piezoelectric material when the latter is subjected to mechanical stress during an oscillation of the mechanical oscillator, the two electrodes being electrically connected to the regulating device which is arranged to be able to vary the impedance of the regulating system, formed by said piezoelectric material, said at least two electrodes and the regulating device, as a function of a time deviation measurement signal provided by the measuring device; wherein said regulating device is arranged to be able to momentarily vary the electrical resistance produced by said regulating device between said two electrodes, the regulating device being arranged to be able to produce time-separated regulating pulses, each consisting of a momentary decrease in said electrical resistance relative to a nominal electrical resistance which is produced by the regulating device between said two electrodes outside said regulating pulses, each of said regulating pulses producing a variation of rate in the mechanical movement which varies as a function of the moment of starting thereof in a half-period of the mechanical oscillator, the characteristic function of said variation of rate relative to said moment of starting of at least one of said regulating pulses respectively in at least one half-period of the mechanical oscillator being negative in a first temporal part of said at least one half-period and positive in a second temporal part of said at least one half-period; and wherein the regulating device is arranged to be able to determine whether a time deviation measured by the measuring device corresponds to at least some gain or to at least some loss, the regulating device being arranged to produce at least one of said regulating pulses with a selectively arranged start, depending on whether the measured time deviation corresponds to said at least some gain or to said at least some loss, in said first temporal part or in said second temporal part respectively of at least one half-period of the mechanical oscillator.

2. The timepiece according to claim 1, wherein said regulating pulses each have a duration less than a quarter of the desired period which is equal to the inverse of said desired frequency.

3. The timepiece according to claim 1, wherein the duration of said regulating pulses is less than or equal to one tenth of a desired period; and wherein the regulating device is arranged to produce at least one of said regulating pulses with a selectively arranged start, depending on whether the measured time deviation corresponds to said at least some gain or to said at least some loss, in a first interval within said first temporal part and wherein said variation of rate given by said characteristic function is greater, in absolute value, than at least half of a maximum variation of rate of said characteristic function in the first temporal part or in a second time interval within said second temporal part and wherein the variation of rate given by said characteristic function is greater than at least half of a maximum variation of rate of said characteristic function in the second temporal part.

4. The timepiece according to claim 3, wherein said regulating device comprises a switch arranged between the two balance spring electrodes, said switch being controlled by a control logic circuit, which is arranged to momentarily close said switch during said regulating pulses in order to turn on/make conductive said switch, said regulating pulses then generating short circuit pulses.

5. The timepiece according to claim 1, wherein said regulating device comprises a switch arranged between the two balance spring electrodes, said switch being controlled by a control logic circuit, which is arranged to momentarily close said switch during said regulating pulses in order to turn on/make conductive said switch, said regulating pulses then generating short circuit pulses.

6. The timepiece according to claim 1, wherein said balance spring comprises a central silicon body, a silicon oxide layer deposited at the surface of said central body for temperature compensation of the balance spring, a conductive layer deposited on the silicon oxide layer, and said piezoelectric material deposited in the form of a piezoelectric layer on said conductive layer, said two electrodes being arranged on the piezoelectric layer respectively on the two lateral sides of the balance spring.

7. The timepiece according to claim 6, wherein first and second parts of the piezoelectric layer, which extend respectively on the two lateral sides of said central body have respective crystallographic structures which are symmetrical with respect to a median plane parallel to said two lateral sides; and wherein said conductive layer forms a single same internal electrode which extends over the two lateral sides of the central body, said internal electrode having no electrical connection of its own to the regulating device.

8. The timepiece according to claim 7, wherein said piezoelectric layer consists of an aluminium nitride crystal formed by crystal growth perpendicular to said conductive layer and from said conductive layer.

* * * * *